United States Patent [19]

Ludovissie

[11] 4,403,715

[45] Sep. 13, 1983

[54] DEVICE FOR DISPENSING A MEASURED AMOUNT OF A PARTICULATE MATERIAL

[76] Inventor: Anthony W. Ludovissie, 1639 E. Constance Dr., Golden Valley, Minn. 55422

[21] Appl. No.: 278,685

[22] Filed: Jun. 29, 1981

[51] Int. Cl.[3] ..... G01F 11/18

[52] U.S. Cl. ..... 222/361

[58] Field of Search ..... 222/361, 362, 278, 430, 222/426, 436, 354, 359, 254, 284; 221/264

[56] References Cited

U.S. PATENT DOCUMENTS 392,911 11/1888 Dean ..... 222/361

3,973,704 8/1976 Horowitz ..... 222/361

*Primary Examiner*—Stanley H. Tollberg

*Attorney, Agent, or Firm*—Williamson, Bains, Moore & Hansen

[57] ABSTRACT

A dispenser is adapted to be attached to a conventional jar-type container in which particulate material, such as instant coffee, is commercially sold. The dispenser includes a mounting member which screws on the container in the manner of a conventional lid. The mounting member has an end wall having a pair of openings therein through which coffee will pass when a container is inverted. The mounting member has a guide structure thereon which slidably receives a slide dispenser. The guide structure has one opening therethrough and the slide dispenser has a pair of openings therethrough. The volumetric space of each opening in the slide dispenser constitutes the volume of coffee which is dispensed when the slide dispenser is shifted in either direction.

1 Claim, 6 Drawing Figures

DEVICE FOR DISPENSING A MEASURED AMOUNT OF A PARTICULATE MATERIAL

SUMMARY OF THE INVENTION

This invention relates to dispensers and more particularly to a dispenser which is adapted to dispense particulate material, such as instant coffee, from a container.

It is the general object of this invention to provide a novel and improved dispenser, of simple and inexpensive construction, which is adapted to be applied to a conventional jar in which particulate material, such as instant coffee, is sold, to permit a user to dispense a predetermined quantity of the particulate material by merely manipulating a slide element.

Another object of this invention is to provide a novel dispenser, preferably molded from plastic and being readily attachable to a jar containing particulate material, such as instant coffee, to permit a predetermined amount of material to be dispensed from the jar by a user by sliding a slide dispenser through a dispensing stroke.

These and other objects and advantages of this invention will more fully appear from the following description made in connection with the accompanying drawings, wherein like reference characters refer to the same or similar parts through the several views.

FIGURES OF THE DRAWING

DESCRIPTION OF THE PREFERRED EMBODIMENT OF THE INVENTION

Figure 1:
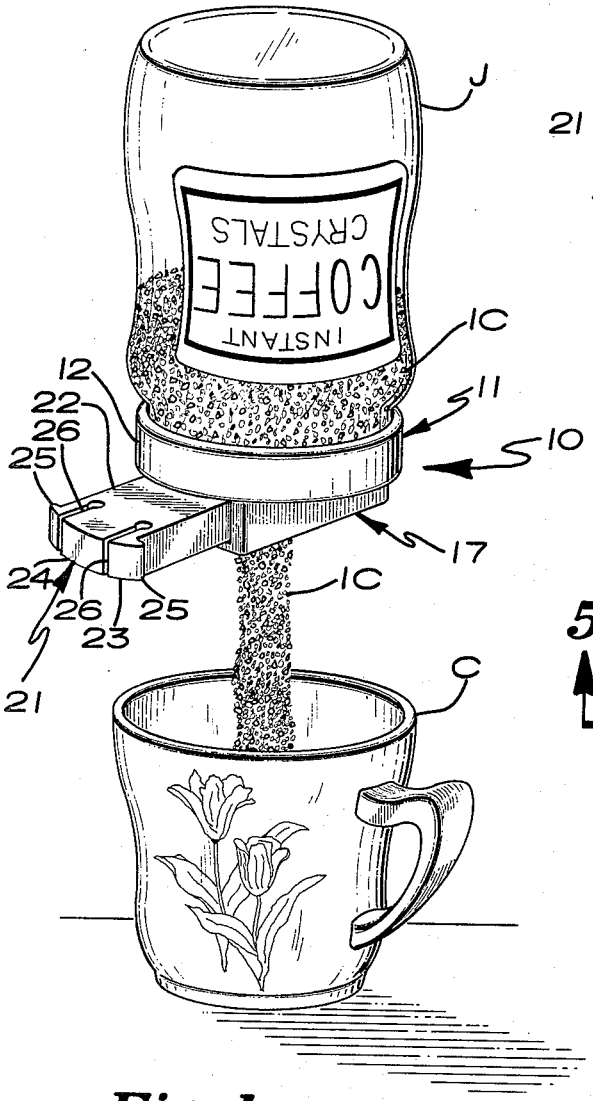
FIG. 1 is a perspective view illustrating the novel dispenser attached to a jar containing instant coffee and illustrating a predetermined amount of instant coffee being dispensed into a cup.
Figure 2:
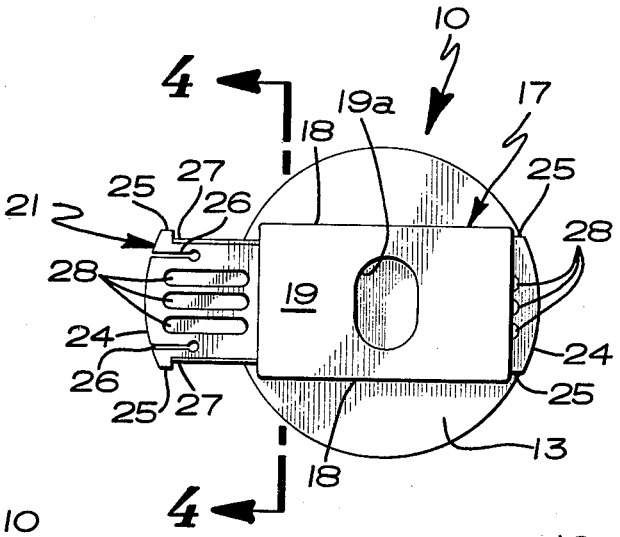
FIG. 2 is a bottom plan view of the dispenser.

Referring now to the drawings and more specifically to FIG. 1, it will be seen that one embodiment of the dispenser, designated generally by reference numeral 10, is thereshown. Although the dispenser may be used to dispense any granulated or particulate material, the dispenser is particularly adapted for use in dispensing instant coffee from its commercial container. The dispenser is adapted to be attached to a conventional jar "J" containing particulate material, such as instant coffee "IC", to permit predetermined amounts of coffee to be dispensed with each manipulation of the dispenser. In this regard, the coffee dispenser 10 includes a mounting member 11 which is comprised of an annular wall 12 which is secured to and integral with a flat, circular end wall 13. The annular wall 12 is provided with internal threads 14 which threadedly engage the threads on the jar "J". Thus, the mounting member 11 is screwed on the jar "J" in the manner of a conventional lid.

Figure 3:
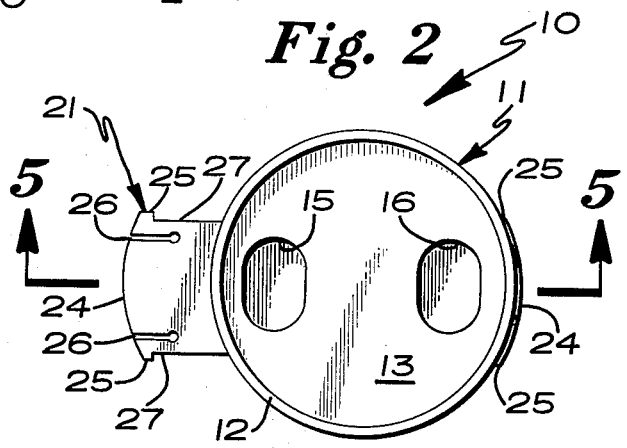
FIG. 3 is a top plan view of the dispenser.
Figure 5:
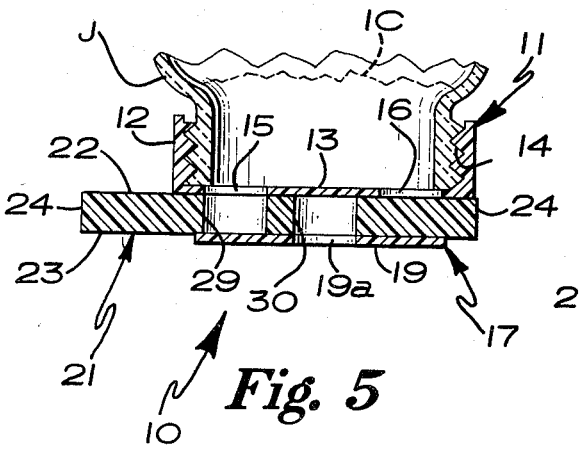
FIG. 5 is a cross-sectional view of the dispenser illustrating one position of the slide dispenser thereof.
Figure 6:
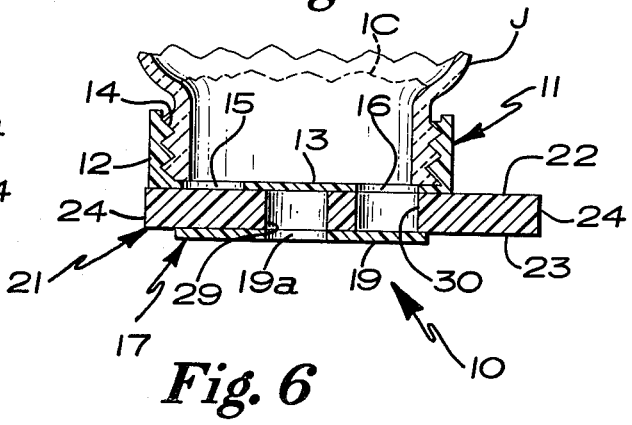
FIG. 6 is a cross-sectional view similar to FIG. 5 but illustrating the slide dispenser of the dispenser in a different position.

Referring now to FIGS. 3, 5, and 6, it will be seen that the end wall 13 is provided with a pair of openings 15 and 16 therethrough and that these openings are identical in size and shape with respect to each other.

The spacing between the openings is also of critical importance and will be explained more fully hereinbelow.

The dispenser also includes a guide structure 17 which is integral with the mounting member 11. The guide structure includes a pair of laterally spaced apart, elongated side walls 18 which are integral with the end wall 3 of the mounting member and which are also integral with a bottom wall 19. The bottom wall 19 is spaced from and disposed substantially parallel to the end wall 13. The bottom wall 19 has a centrally located opening **19*a* therethrough which has a size and shape corresponding to the size and shape of the openings 15 and 16 in the end wall 13**.

The dispenser also includes an elongated, generally rectangular shaped, flat slide dispenser 21. It is pointed out that the entire dispenser is preferable molded from an inert plastic material, preferably polyethylene or the like. The slide dispenser 21 has elongates side edges 22, pair of arcuate end edges 24 and a substantially flat planar upper surface 22 and a flat planar lower surface 23. The slide dispenser 21 is positioned in the guide structure so that the side edges thereof engage the inner surfaces of the side walls of the guide structure. The upper and lower surfaces, respectively, of the slide dispenser engage the end wall of the mounting member and the bottom wall 19 of the guide structure. The side edges 22 of the slide dispenser are disposed in a mating manner with enclosed inner surfaces 20 of the side walls of the guide structure.

Sliding movement of the slide dispenser is limited by stop means on the slide dispenser which engage the guide structure. To this end, it will be seen that the slide dispenser 21 is provided with a pair of outwardly projecting ears 25 at each end thereof that are disposed in confronting relation with the guide structure 17 so that sliding movement of the slide dispenser is limited in either direction. It will also be seen that one end portion of the slide dispenser is provided with a pair of laterally spaced apart, similar, elongated, longitudinally from the curved end thereof to define a pair of fingers 27 at that end of the slide dispenser. When it is desirable to remove the slide dispenser from the guide structure, it is only necessary to press the fingers 27 inwardly towards each other and this permits the obstructing ears 25 to move inwardly past the guide structure and thus permits removal of the slide dispenser from the guide structure.

Figure 4:
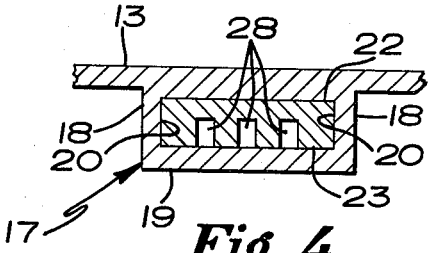
FIG. 4 is a cross-sectional view taken approximately along 4—4 of FIG. 2 and looking in the direction of the arrows.

It will also be noted, as best seen in FIG. 4, that the slide dispenser has a plurality of elongated grooves 28 therein that open outwardly through the lower surface thereof. It is essential that the slide dispenser be positioned in the guide structure 17 to orient the grooves in a downwardly opening manner. Although not shown in the drawing, there is a slight inclination of the side edges of the slide dispenser and a slight inclination of the inner surface of the guide structure due to molding. The interaction of the inclined sides of the slide dispenser with the guide structure compels this orientation.

The slide dispenser is also provided with a pair of openings 29 and 30 therein, these openings being of a size and shape corresponding to the openings in the end wall of the mounting member and the bottom wall of the guide structure. However, it will be noted that the spacing between the openings 29 and 30 in the slide dispenser is substantially less than the spacing between the pair of openings 15 and 16 in the end wall of the mounting member. The spacing between the openings 29 or 30 is of a magnitude so that when one of the openings 29 or 30 is disposed in registering relation with one of the openings 15 or 16 in the mounting member, the other opening in the slide dispenser will be disposed in registering relation with the opening 19*a* in the guide structure. Registering relation of these openings in this manner occurs only when the slide dispenser is at its limit of movement in either direction with respect to the guide structure. It will, therefore, be seen that when one of the openings 29 or 30 is disposed in registering relation with an opening 15 or 16 in the mounting member, a predetermined amount of coffee will fall into the opening 29 or 30 by action of gravity. Thereafter, when the slide dispenser is moved in the opposite direction through a complete stroke, the coffee contained within this opening will be moved into registering relation with the opening 19*a* in the guide structure thereby permitting the coffee to be dispensed into a cup "C". It will, therefore, be appreciated that the volumetric space defined by each opening 29 or 30 in the slide dispenser defines the quantity or amount of coffee to be dispensed during each manipulation of the dispenser. It is preferred that each opening 29 and 30 correspond to some predetermined quantity such as a half teaspoon amount. With this arrangement, each time the slide dispenser is manipulated, a half teaspoon of instant coffee will be dispensed into a cup.

From the foregoing description, it will be seen that the dispenser can be readily applied to any conventional container and thereby render the container capable of dispensing a desired amount of instant coffee into a cup by the user. This obviates the need of removing the conventional lid from the container and measuring out a predetermined amount with a spoon which is the normal practice followed by users of instant coffee. The dispenser is formed of a chemically inert material and will therefore not corrode and is easily cleanable by merely removing the slide dispenser from the guide structure. Uniform amounts of coffee are dispensed with each shifting movement of the slide dispenser, although a user may prefer to use two increments of coffee if desired.

Thus, it will be seen that I have provided a novel dispenser device, which is not only of simple and inexpensive construction, but one which functions in a more efficient manner than any heretofore known comparable device.

While the preferred embodiments of the present invention have been described, it should be understood that various changes, adaptations, and modifications may be made therein without departing from the spirit of the invention and scope of the appended claims.

What is claimed is:

1. A particulate dispensing device, comprising:

a mounting member having an annular wall and having a flat, circular wall, said annular wall having means on the inner surface thereof adapted to engage the external means on the upper end of a conventional jar containing a particulate material such as instant coffee, said end wall having a pair of spaced apart similar openings therethrough;

a guide structure including opposed spaced apart sidde walls integral with said end wall of said mounting member, a substantially flat bottom wall integral with said side walls and spaced from said end wall of the mounting member, said bottom wall having a centrally located opening therethrough corresponding in size and shape to each opening in the end wall;

an elongated, generally rectangular shaped slide dispenser having side edges, substantially flat upper and lower surfaces, and end edges, said slide dispenser having a pair of spaced apart similar openings therethrough each corresponding in shape and size to the openings in said end and bottom walls, said slide dispenser being slidable in opposite directions in said guide structure, means on said slide dispenser engaging said guide structure to limit sliding movement of said slide dispenser in either direction, said slide dispenser when slid the limit of movement in either direction intercommunicating the other opening in the slide dispenser with the opening in the bottom wall of the guide structure whereby when the slide dispenser is shifted in either direction throughout its extent of movement, a predetermined amount of particulate material will be dispensed; and means on one end of said slide dispenser being shiftable to permit said slide dispenser to be removed from said guide structure, said shiftable means at one end of said slide dispenser comprising a pair of fingers each having a top element thereon for limiting movement of the slide dispenser in one direction, said fingers being movable toward each other to permit said slide dispenser to be removed from said guide structure.

* * * * *